US006378862B1

(12) United States Patent
Rebeaud

(10) Patent No.: US 6,378,862 B1
(45) Date of Patent: Apr. 30, 2002

(54) METHOD OF POSITIONING SHEET ELEMENTS IN THE INTRODUCTION STATION OF A PROCESSING MACHINE AND A SYSTEM FOR PERFORMING THE METHOD

(75) Inventor: Jean-Claude Rebeaud, Le Mont (CH)

(73) Assignee: Bobst SA (CH)

( * ) Notice: Subject to any disclaimer, the term of this patent is extended or adjusted under 35 U.S.C. 154(b) by 0 days.

(21) Appl. No.: 09/525,504

(22) Filed: Mar. 15, 2000

(30) Foreign Application Priority Data

Apr. 9, 1999 (CH) ..... 0671/99

(51) Int. Cl.[7] ..... B65H 9/10

(52) U.S. Cl. ..... 271/243; 271/239; 271/230

(58) Field of Search ..... 271/226, 230, 271/234, 236, 239, 241, 243, 251

(56) References Cited

U.S. PATENT DOCUMENTS

| | | | | | |
|---|---|---|---|---|---|
| 2,922,646 | A | | 1/1960 | Büttner | 271/54 |
| 3,986,713 | A | | 10/1976 | Wirz | 271/268 |
| 4,591,143 | A | * | 5/1986 | Jeschke | 271/236 X |
| 4,674,739 | A | * | 6/1987 | Smith | 271/268 |
| 4,738,442 | A | * | 4/1988 | Rodi et al. | 271/261 |
| 4,848,762 | A | * | 7/1989 | Beery | 271/161 X |
| 5,176,079 | A | * | 1/1993 | Pollich | 101/232 |
| 5,287,809 | A | * | 2/1994 | Greive | 271/243 X |
| 5,301,938 | A | * | 4/1994 | Casper | 271/243 X |
| 6,244,592 | B1 | * | 6/2001 | Baba et al. | 271/243 |

FOREIGN PATENT DOCUMENTS

| | | | |
|---|---|---|---|
| CH | 676695 | | 2/1991 |
| FR | 2254435 | | 7/1975 |
| JP | 409040231 A | * | 2/1997 |
| JP | 410109786 A | * | 4/1998 |

OTHER PUBLICATIONS

Search Report dated Aug. 23, 2000.

* cited by examiner

*Primary Examiner*—Christopher P. Ellis
*Assistant Examiner*—Patrick Mackey
(74) *Attorney, Agent, or Firm*—Ostrolenk, Faber, Gerb & Soffen, LLP

(57) ABSTRACT

A device for positioning a sheet element in a processing machine has a movable base, a shelf movable with and relative to the movable base, and actuators which are operative to controllably displace the shelf relative to the movable base in such a manner that a front edge of the sheet element engaged by the shelf is stopped in a predetermined position.

16 Claims, 3 Drawing Sheets

METHOD OF POSITIONING SHEET ELEMENTS IN THE INTRODUCTION STATION OF A PROCESSING MACHINE AND A SYSTEM FOR PERFORMING THE METHOD

FIELD OF THE INVENTION

This invention relates to a method of and a system for positioning sheet elements in the introduction station of a machine for processing sheet material, and more particularly a system for positioning a sheet of paper, cardboard or similar material very accurately in the introduction station of the machine, just before the leading edge of said sheet is gripped by a transport system comprising a series of grippers mounted on a transverse bar connected to side chains subsequently feeding said sheet to the different subsequent processing stations of the machine, such as the printing, cutting or other stations.

BACKGROUND OF THE INVENTION

In the positioning systems currently in use, the sheet is jogged on the feed table against front and lateral stops by means of feed members such as rollers or bands of elastic material descending from above on to the table, or a pair of rollers arranged above and below the table.

In the case of untreated sheets, the front and side stops used are disposed exactly with respect to the references of the subsequent stations. The sheet is then rapidly pushed against the stops by the feed members and then gripped by the gripper bar. The stops are then retracted and the gripper bar can pull the sheet to the following processing station and position it exactly with respect to the tools of the platen of that station.

Positioning is slightly more complicated when the sheet has previously undergone one or more processing operations, for example printing or scoring of fold lines, and the subsequent processing operations have to be carried out very accurately with reference to the results of the previous processing operations. The patent CH 676695 discloses a positioning system in which the stops are motor-driven so as to be able to control a variation in their position and wherein a printing mark or other distinctive sign of the previous processing operation can be logged by opto-electronic reading means in order to adjust the position of the stops, and hence of the sheet, directly in dependence on the mark or sign.

However, these stop type positioning systems mean that the advance of each sheet must be practically stopped for the entire duration of its jogging and adjustment operation, and this substantially limits the possible speed of movement of the sheets in the machine.

Also, the fact that a sheet is applied against a stop may result in the formation of an unsightly mark on the corresponding edge. The swelling of this mark may also interfere with the introduction of the sheet in critical circumstances.

The object of this invention is to provide a method of and a system for positioning sheet elements, such as sheets of paper, cardboard or similar material, in the introduction station of a processing machine, such method and systems being faster so as to allow the machine cycle to be increased while remaining very accurate, particularly in the case of sheets which have received a previous treatment. Preferably, the system should leave no mark on the sheet element. Nevertheless, the design of this system must remain relatively simple in order to increase its reliability, simplify maintenance, and reduce the production costs as far as possible.

SUMMARY OF THE INVENTION

These objectives are achieved by a method of positioning sheet elements in the introduction station of a processing machine comprising, starting from a shelf in a rear starting position, engaging means for fixing a sheet element on the shelf, then controlling actuators to advance the shelf forward and if necessary sideways and/or askew depending on the readings of opto-electronic means, said readings being effected at the start of the advance of the shelf so as to feed and finally stop the leading edge of the sheet element in the grippers of a drive bar in a predetermined position, releasing the fixing means, and then returning the shelf to the rear starting position.

Thus after the reading of the effective position of the sheet element with respect to the shelf by the opto-electronic means during a first phase of the shelf advance, the subsequent advance phase can be utilized to advantage to effect adjustments of the movement of the shelf with respect to its basic travel in order very dynamically to correct any longitudinal, lateral or skew errors of the sheet element. If the sheet element is untreated, the corrections can be advantageously carried out on the basis of logging its edges; if the sheet has previously been processed, the corrections are advantageously carried out on the basis of a reference mark of, or distinctive signs corresponding to, said treatment. The corrections thus made during sheet movement mean that it is no longer necessary to stop the sheet element uselessly, so that the possible rate of operation of the machine can be substantially increased.

The method of controlling the positioning system therefore comprises, starting from the rear starting position of the shelf, controlling the actuators to advance the shelf forward until the leading edge of the sheet element has been detected by the opto-electronic means, then controlling the corresponding actuator in order to move the shelf transversely until the side edge of the sheet element has been detected by the opto-electronic means.

Preferably, the control method comprises, starting from the shelf in the rear starting position, controlling the actuators to advance the shelf forward at a constant speed until the machine gripper bar arrives at the standby position for receiving a sheet element, then controlling the actuators to effect adjustments of the movement of the shelf with respect to its basic travel in order to correct any longitudinal, lateral or skew errors of the sheet element as determined by the readings of the opto-electronic means and finally to stop the leading edge of the sheet element in position in the grippers of the drive bar.

Thus by postponing the shelf correction movements to the end of its travel only when the gripper bar has arrived in the standby position, this obviates any adverse collision risk between the two elements which might be caused by unpredictable acceleration of the shelf.

The system for positioning sheet elements in the introduction station of a processing machine comprising a transport system made up of one or more gripper bars for driving the sheet element to the subsequent stations comprises:

a shelf provided with means for temporarily fixing the sheet element, having a notched leading edge complementary to the grippers of the drive bar driven by actuators on the one hand in reciprocating longitudinal translation from a rear starting position to a forward position at the level of a gripper bar in standby to receive a sheet element, and on the other hand in complementary longitudinal translation and/or in transverse translation and/or in rotation about a vertical axis, opto-electronic means reading the front and/or side edge and/or a distinctive sign of a previous treatment of the sheet element disposed slightly forwardly of the starting position of the shelf, electronic control means for controlling the actuators of the shelf in dependence on the machine cycle and the results of the readings of the opto-electronic means.

The pneumatic temporary fixing means for the sheet element on the shelf may comprise a network of apertures formed on the top surface of the shelf communicating with an internal chamber connected by an electromagnetic shut-off/opening valve to a negative pressure supply. However, pneumatic means of this kind prove to be relatively slow and complex to use.

According to a preferred embodiment, the temporary fixing means comprise a comb mounted pivotably above, near and parallel to the front notched edge of the shelf, the teeth of the comb being oriented forward so that each of them forms with each projection of the shelf separating a notch a gripper for gripping the leading edge of the sheet element, and means for controlling the angular position of the comb.

Advantageously, the means for controlling the angular position of the comb comprise on the one hand one or more springs disposed between the shelf and the rear bar connecting the teeth of the comb so that, at rest, said spring raises the rear bar and holds the comb closed, i.e. with the teeth bearing on their shelf projection, and on the other hand, connected to the station, one or more subjacent control means having a vertical movement, such that the end of a lever actuated for rotation or the output rod of a pneumatic or electropneumatic jack, and each connected by a telescopic pendular link to the rear bar of the comb, so that in the bottom position it can bear on and lower the rear bar of the comb and thus hold the comb open during a movement of the shelf.

Thus when the pendular telescopic link is in the top position with its rod sliding freely on the advance of the shelf, the spring ensures effective closure of the comb, hence firm holding of the sheet element during its feed and its position corrections. On the other hand, when the telescopic link is in the bottom position with its rod in abutment on withdrawal of the shelf on its return to its rear starting position, it opens the comb and holds it open in this way despite the movement of said shelf as a result of the pendular arrangement of said link.

Thus the sheet element is held along its leading edge uniformly and with a practically constant pressure in order to obviate the formation of any adverse mark. Also, the fact that said leading edge is held flat on the shelf projections enables said sheet element edge to be inserted without any risk of snagging in the open grippers of the machine drive bar.

According to a preferred embodiment, the longitudinal translation is effected by a precision actuator which provides the movement and longitudinal position correction.

According to one advantageous embodiment, the shelf is mounted on each side on a lateral vertical pivot respectively connected to a carriage moving along a longitudinal guide by means of a linear actuator supported by the base cross-member.

In this case, when the actuators advance in synchronism, the shelf simply performs a purely longitudinal complementary translatory movement in the forward direction. On the other hand, the introduction of a slight offset between the movements of each of the lateral actuators enables the shelf to be voluntarily put askew by rotation about a vertical axis to take up any initial skewing of the sheet element.

According to another advantageous embodiment, the shelf is mounted at its centre on a central vertical pivot and on each side on a vertical lateral pivot, the central pivot being connected to a carriage sliding in a longitudinal guide adapted to be moved transversely by a first linear actuator, each side pivot being connected to a carriage sliding in a transverse guide adapted to be moved longitudinally respectively by a second and third linear actuator, the first, second and third actuators being supported on the base cross-member.

As before, when the second and third actuators advance in synchronism, the shelf simply effects a purely longitudinal forward translatory movement, the carriage of the central pivot simply following the movement within its longitudinal guide. Also, the introduction of a slight offset between the movements of the second and third actuators enables skewing to be voluntarily induced in the shelf to take up any corresponding initial error of the sheet element. On the other hand, the use of the first actuator results in a transverse movement of the shelf, the carriages of the lateral pivots then only following that movement within their transverse guide.

As a result of this symmetrical kinematics with respect to the central longitudinal vertical plane, it is a simple matter to transmit to the shelf any longitudinal, transverse or pivoting correction on itself, by separate control of just three linear actuators.

In this latter positioning system according to the invention, the position control of the first actuator is carried out with respect to a reference established in dependence on the transverse position error of the sheet element as read by the opto-electronic means. The second and third actuators are in turn controlled in position with respect to a correction reference for longitudinal errors and/or skew errors as also read by the opto-electronic means. With regard to the shelf actuator, its position is controlled by a reducing reference with respect to the machine cycle, which is usually denoted by the main motor output shaft angle, said reducing reference being representative of the basic front to rear movement for feeding the sheet element.

The linear actuator used may be a carriage sliding along a guide and the transverse tapping of which is engaged on an endless-thread rod, one of the ends of which is driven in rotation by an electric motor. Another possibility is a rack mounted to slide freely on bearings and with the teeth meshing with a pinion driven by an electric motor. However, these actuators make use of intermediate mechanical links which transform the rotary movement of the output shaft of an electric motor into a translatory movement, and these connections always have a relative inertia and some play in operation.

According to a preferred embodiment, the linear actuators are linear electric motors the rotor of which is in the form of a bar movable in translation and provided with a series of permanent magnets moving with respect to one or more loops of a stator supplied with electrical current, said bar directly supporting either the pivot support or the transverse guide within which the pivot carriage slides.

By means of such linear electric motors there is very dynamic direct action on the part being moved, whether the pivot support or an intermediate guide. In particular, in the case of any risk of collision between the shelf and the gripper bar all that is necessary is to reverse the polarity with which the stator loops are connected in order to be able to instantly stop and withdraw the shelf.

In the case of untreated sheet elements, the opto-electronic means for detecting the edges of the element may comprise just one pair of front photoelectric cells and one lateral photoelectric cell.

According to an advantageous alternative, the opto-electronic means for detecting the side edges of the sheet element may be an array of photoelectric cells or CCD strip, enabling a transverse movement to be transmitted to the shelf in order specially to log the side edge.

In the case of sheet elements which have previously undergone one or more processing operations, the opto-electronic means for detecting the or each mark or other distinctive signs of the previous processing operation may be a CCD array or some other camera capturing an image of the sheet element on the movement of the shelf. Electronic means are known for processing the image to enable the marks and their forms to be recorded in order to deduce the longitudinal and lateral positioning errors therefrom.

BRIEF DESCRIPTION OF THE INVENTION

The invention will be more readily understood from the study of one embodiment which is given without any limiting force and illustrated in the accompanying drawings wherein.

DETAILED DESCRIPTION OF THE DRAWINGS

Figure 1:
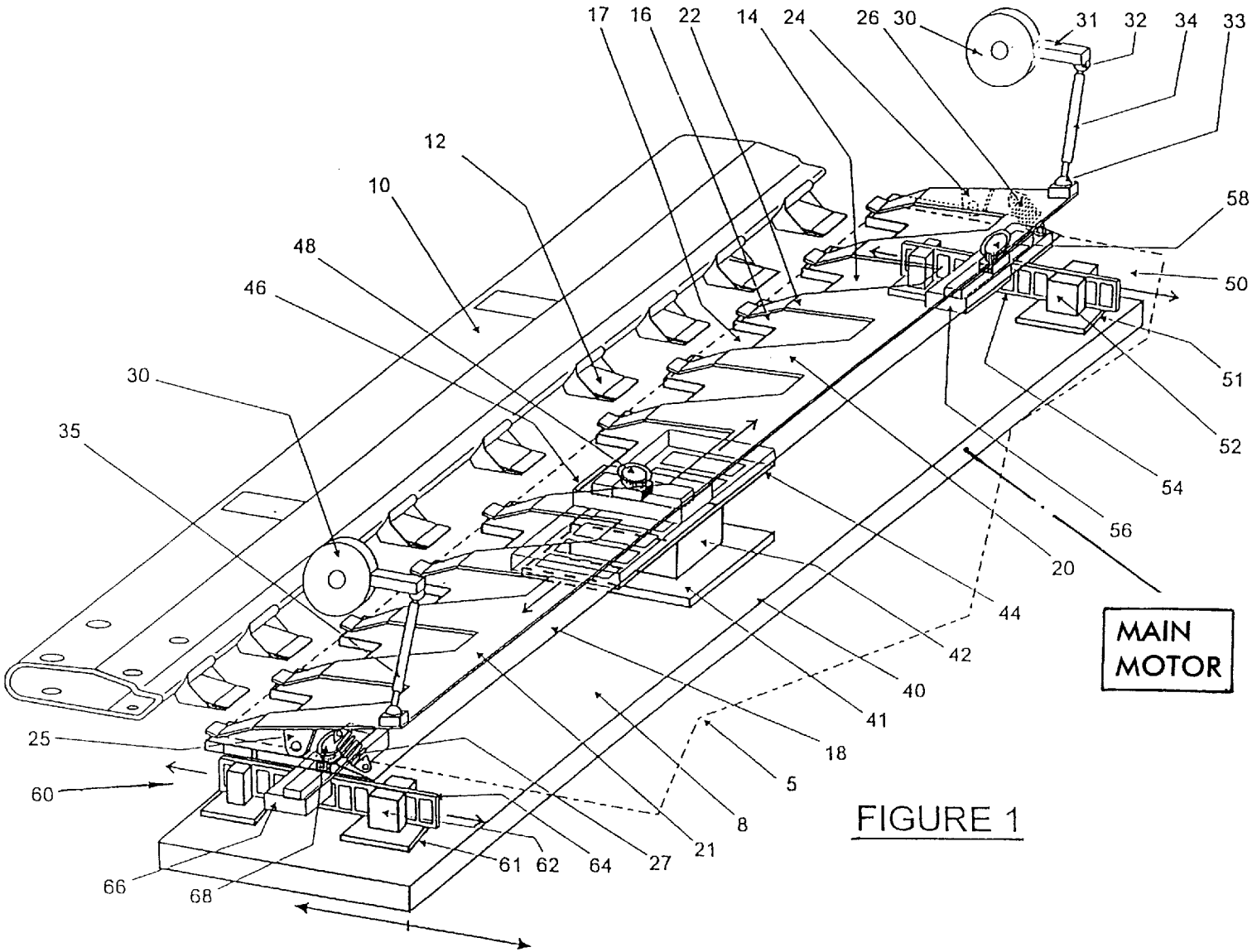
FIG. 1 is a diagrammatic perspective view of a positioning system according to the invention.

The left-hand part of FIG. 1 shows a gripper bar 10, the rear edge of which comprises a plurality of grippers 12 adapted to grip the leading edge of a sheet 5. The bar 10 is attached at each of its two side ends to a chain for driving it to the subsequent treatment stations followed by a return along an upper loop towards the initial standby position for receiving a new sheet.

More particularly according to the invention, a sheet 5 is fed and positioned accurately in the grippers 12 by means of a horizontal shelf 14 which on the one hand performs a reciprocating longitudinal movement from front to rear to find said sheet and feed it and on the other hand corrective movements taking into account the effective position of said sheet on said shelf.

To this end, the shelf 14 is first mounted on a horizontal base cross-member 8 pivotable about its horizontal axis, thus ensuring transfer of the sheet element from the said shelf 14 to the gripper 12 carried by the gripper bar 10.

More particularly according to the invention, the shelf mounted on the cross-member 8 is movable in longitudinal translation, transverse translation and askew, i.e. in instantaneous rotation about a vertical axis. In particular, said shelf 14 is articulated on three vertical pivots, a central pivot 48 and two side pivots respectively: one 68 on the left on the "operator side" CC, and one, 58, on the right, on the "side remote from the operator" COC. The central articulation pivot 48 is connected to a carriage sliding inside a longitudinal guide 46, while the carriages of the side pivots 58 and 68 are both slidable inside transverse guides 56 COC and 66 CC.

The central longitudinal guide 46 is in turn supported by a movable bar 44 comprising permanent magnets and forming the movable stator of a central linear electric motor 40, of which the stator 42 rests by a base 41 at the centre of the base cross-member 8. Similarly, the transverse guide COC 56 and the transverse guide CC 66 are respectively connected to a bar COC 54 and a bar CC 64 having permanent magnets forming a linear electric motor rotor COC 50 and CC 60, of which the stators 52 and 62 respectively rest by their bases 51 and 61 at each of the ends of the base cross-member 8.

The movable bars 44, 54, 64 may have a row of permanent magnets on one of the surfaces of the bar, the stator then comprising just a single winding opposite; or, preferably, a row of permanent magnets on either side, the stator then having two windings respectively facing each of the rows. Permanent-magnet actuators of this kind with a good dynamic efficiency are available commercially, and are in particular marketed by the Swiss company ETEL under the reference LMA11/50.

The said linear motors 40, 50, 60 are provided primarily to impart to the shelf 14 movements and corrections of the order of ten to twenty millimeters over a total travel of about one hundred millimeters. In particular, if the two linear actuators COC 50, CC 60, advance in synchronism, the shelf 14 performs a movement purely in longitudinal translation towards the gripper bar 10. On the other hand, if one of the linear motors 50, 60 voluntarily has a movement of a different amplitude from that of the other, that results in the bar 14 being moved askew by pivoting about the pivot 40 which can simultaneously advance or recede. Also, the use of the central linear electric motor 40 imparts a transverse movement to the shelf 14, the pivots 58 and 68 following this movement inside their respective guides 56, 66.

The sheet 5 is temporarily fixed to the shelf 14 by a series of front grippers formed on the one hand by projections 16 on the leading edge of the shelf cooperating with teeth 22 of a comb 20. In particular, the shelf edge projections 16 define notches 17 in register with the grippers 12 of the bar 10, said notches being substantially wider than the grippers 12 in order to allow any transverse movements of the shelf 14 communicated by the central linear motor 40.

The teeth 22 are connected by a rear strip 21 so as together to form a comb 20 mounted at each of the side ends for pivoting by way of arms 24 and 25 which allow the opening of the shelf grippers followed by their closure. More particularly according to the invention, two side springs COC (side remote from the operator) 26 and CC (operator side) 27 are disposed between the shelf 14 and the rear strip 21 of the comb 20 so as to hold, normally at rest, the comb 20 and hence the grippers 16, 22 in the closed state. This gripper is in particular closed when it entrains a sheet 5 to feed it and position it in the grippers 12 of the bar 10.

A voluntary opening mechanism for the comb 20 comprises, at each side end, a pendular telescopic link COC 34 and CC 35 articulated at the level of the rear comb strip 21 by a lower swivel joint 33, and at the end of a lever 31 by a top swivel joint 32, the lever 31 being adapted to being raised or lowered by a rotary disc 30. Thus when the lever 31 is held in the top position, the arm of the telescopic link slides freely and does not apply any force to the strip 21, which is then urged upwards by the springs 26, 27. Conversely, in particular during the entire return travel of the shelf 14 to the rear position, the discs 30 have pivoted in the clockwise direction to lower their respective levers 31, the telescopic link rod coming into abutment so as to bear on the rear strip 21 and thus swing the gripper teeth 22 upwards. A possible pivoting movement of the links about their top upper end 32 enables the combs 20 to be kept voluntarily open during the entire return travel.

It should be noted that the rear edge 18 of the shelf 14 is oriented obliquely downwards to facilitate the introduction of a new sheet on its upper surface, hence into the grippers 26/22. Of course the mechanism for opening the comb 20 could advantageously be constructed by replacing the pendular telescopic link COC 34 and CC 35 respectively, comprising a secondary rotary disc connected to a cam while being independent of the disc 30 so as to generate a stroke which enables a non-telescopic slide to be used.

Figure 2:
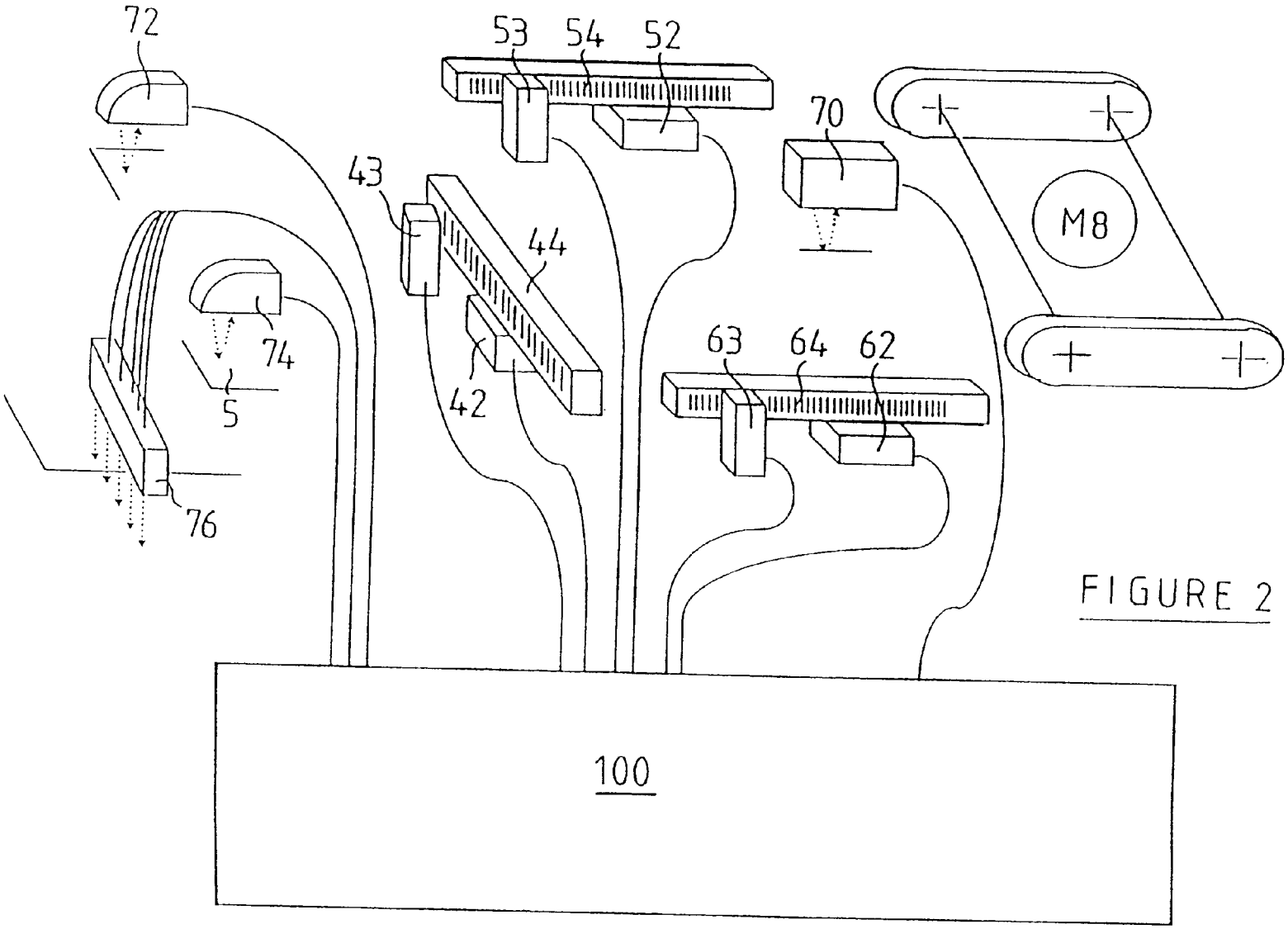
FIG. 2 is a diagrammatic view of the opto-electronic means and electronic means for controlling the positioning system according to the invention.

FIG. 2 diagrammatically illustrates the means for controlling the positioning system described with reference to FIG. 1.

The rotor bars and the stators COC 54/52, central 42/44 and CC 64/62 respectively of the linear motors supporting the shelf 14 on the cross-member 8 will be seen in particular. As illustrated, each rotor bar has a rule graduated for reading by a cell 43, 53, 63 respectively which enables a feedback signal to be generated to control the linear electric motors by position control effected along a reducing position reference curve, said control being effected in known manner within a microprocessor 100.

The positioning device according to the invention also comprises a pair of side-by-side cells 72, 64 for detecting the leading edge of a sheet 5 and a lateral cell strip 76 enabling the side edge of the same sheet to be detected. The results of the reading of these cells are applied also to the microprocessor 100. If required, the system may also comprise a reading cell 70 for detecting the presence of a sheet for gripping or detecting the passage of the shelf only after a predetermined time to obviate any possible collision with the gripper bar 10.

Figure 3:
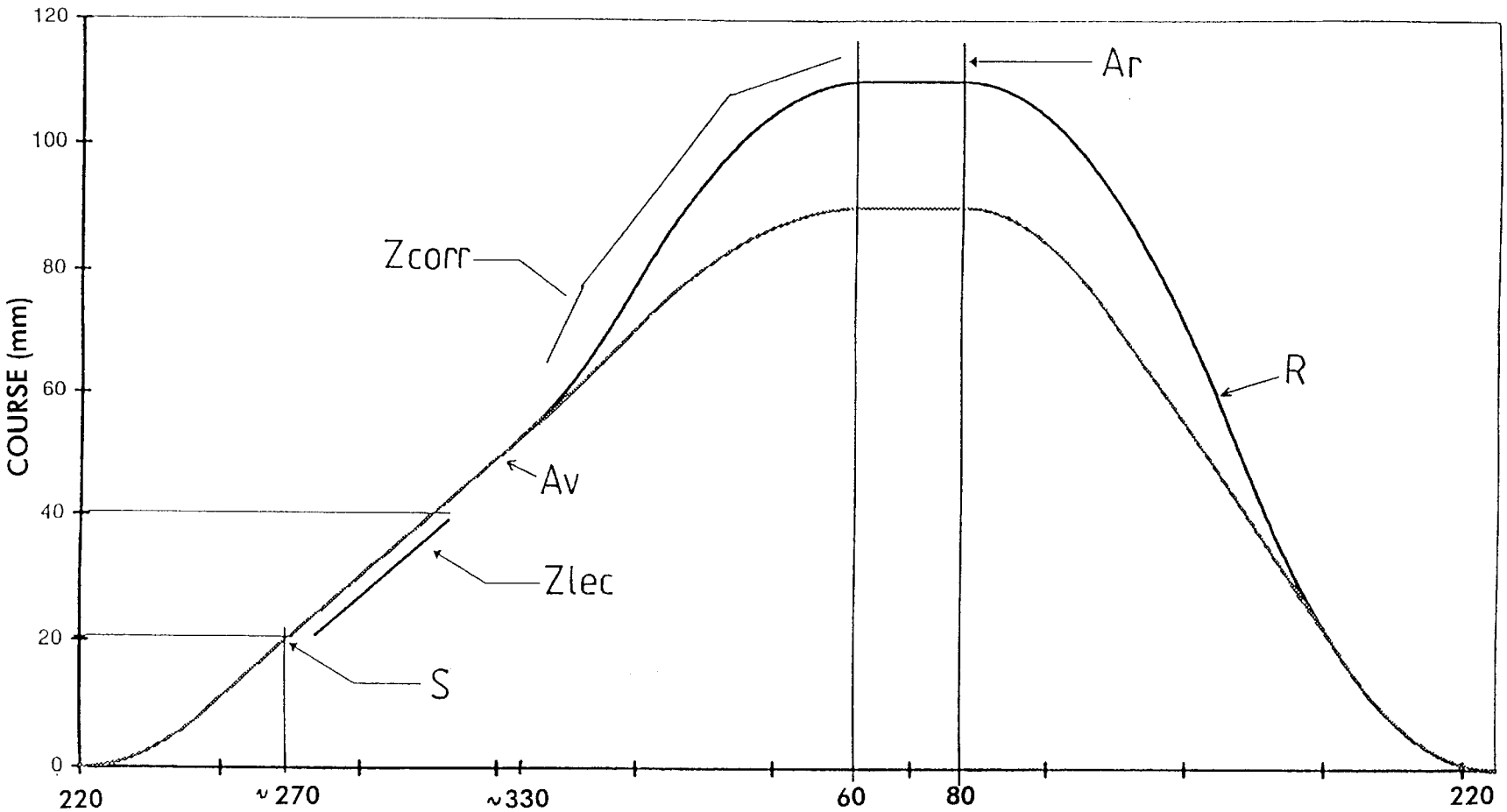
FIG. 3 is a graph showing the movement of the shelf of the positioning system according to the invention against a reference of the machine cycle.

The mode of operation of the positioning system according to FIGS. 1 and 2 will be more readily understood from the diagram in FIG. 3 which illustrates the travel of the shelf 14 during a machine cycle. The reference of a cycle is usually the angular position of the output shaft of the main motor, the x-axis of the graph corresponding to a complete 360° revolution. This cycle starts and finishes at the same 220° "machine" reference corresponding to the time when the shelf is instantaneously the furthest back motionless and ready to start off again.

During a first phase, the shelf 14 starts forward and assumes the speed to reach the speed of advance of the sheet which it grips in motion at time S, the discs 30 of the levers 31 rotating rapidly in the anticlockwise direction to release the comb and close the grippers 16 and 22.

During the next phase Zlec, which lasts about 30°, the leading edge of the sheet 5 is detected by the pair of cells 72, 4 and the side edge is detected by the cell strip 76, so that the microprocessor 100, which knows the basic travel of the shelf 14, can determine the positioning error of the sheet 5 with respect to its theoretical position. The microprocessor can then establish the presence or absence and magnitude of any positioning errors, both longitudinal and transverse, and skew, of the sheet and establish correction references.

The subsequent phase Av, which lasts about 30°, corresponds to the sheet being fed by the shelf 14 at a constant speed so calculated as to initially allow the gripper bar 10 to pass and reach the standby position.

Once the gripper bar has passed, the microprocessor 100 can then apply correction references to the linear electric motors 40, 50, 60 so as to move the shelf accordingly. This correction phase Z takes about 90° and the amplitude of the shelf travel is then dependent on the magnitude of the corrections as represented by the minimum and maximum travel.

The following phase Ar, which lasts about 20°, corresponds to the stoppage of the leading edge of the sheet 5 at the centre of the grippers 12, which close, so that then the comb 20 can open only by the descent of the levers 31.

The phase R corresponds to the return of the shelf to the initial starting position at constant speed, this movement being on the one hand communicated by the base cross-member 8 and on the other hand by the linear electric motors respectively returning to a neutral position. A new sheet feed cycle can then restart.

As is apparent from the foregoing, the system for positioning a sheet element according to the invention is distinguished in that it enables a sheet to be gripped while in movement and, while feeding it to the grippers of the drive bar, enables its position to be read so as to calculate any errors and, while continuing its advance, enables any errors of this kind to be compensated so that the sheet is finally positioned just in time in a remarkably accurate manner within the bar grippers. Unlike the prior-art stop systems, the positioning correction in this case does not require any stoppage of the sheet advance, so that the machine cycle can be substantially increased to reach values of up to 12000 sheets per hour. The use of linear electric motors substantially simplifies the design of the system and hence production and maintenance costs.

Numerous improvements can be made to the system within the scope of the claims.

What is claimed is:

1. A method for positioning a sheet element, which is displaceable along a travel path between an introduction station and subsequent downstream stations of a processing machine, comprising the steps of:

engaging the sheet element with shelf grippers of a shelf in a starting position of the shelf at the introduction station;

advancing the shelf with the engaged sheet element along the travel path;

determining positioning coordinates of the sheet element during advancement of the shelf along the travel path using opto-electronic detectors;

controllably actuating shelf actuators in response to determination of the positioning coordinates of the sheet element in such a manner that the shelf is selectively displaceable parallel to the travel path, transversely to the travel path and askew to the travel path toward a predetermined position of a leading edge of the sheet element while the shelf is displaceable along the travel path;

stopping the shelf when the leading edge of the sheet element reaches the predetermined position;

engaging the leading edge in the predetermined position using transport grippers of a transport system;

releasing the shelf grippers to allow the transport system to displace the sheet element toward the subsequent downstream stations; and returning the shelf to the starting position.

2. The method as defined in claim 1, wherein the shelf is advanced along the travel path at a constant speed to an intermediate position which is located between the starting position of the shelf and the predetermined position of the leading edge of the sheet element, the method further comprises a step of displacing the transport grippers to the predetermined position of the leading edge before the leading edge reaches the predetermined position thereof.

3. The method defined in claim 2, further comprises a step of varying the constant speed after the shelf has reached the intermediate position in response to determining the positioning coordinates.

4. A method for positioning a sheet element displaceable along a travel path between an introduction station and subsequent stations of a processing machine, comprising the steps of:

engaging the sheet element with shelf grippers of a shelf in a starting position of the shelf at the introduction station, thereby advancing the shelf with the sheet element toward a predetermined position of a leading edge of the sheet element along the travel path;

detecting positioning errors of the sheet element while it is displaceable along the travel path with the shelf;

controllably actuating shelf actuators to selectively displace the shelf transversely and askew to the travel path in response to detection of the positioning errors, thereby adjusting a position of the sheet element in such a manner that the leading edge of the sheet element is stopped in the predetermined position thereof;

engaging the leading edge of the sheet element with transport grippers in the predetermined position to advance the sheet element toward the subsequent stations upon disengaging the shelf grippers.

5. A device for positioning a sheet element at an introduction station of a processing machine, the sheet element has a front edge and side edges, the device comprising:

a shelf displaceable reciprocally along a travel path between a rear position and a front position, the shelf having a leading edge provided with notches;

a shelf gripper displaceable with the shelf and releasably engaging the sheet element along the travel path to advance the sheet element toward a predetermined position of the front edge of the sheet element, the front position of the shelf corresponding to the predetermined position of the front edge of the sheet element;

opto-electronic detectors located downstream from the rear position along the travel path and operative to detect a position of the sheet element while it is displaceable toward the predetermined position of the front edge along the travel path, the opto-electronic detectors being operative to generate signals in response to detection of the position of the sheet element;

a controller operative to receive the signals from the opto-electronic detectors and to determine positioning errors of the detected position of the sheet element, the controller being operative to generate at least one output signal in response to determining the positioning errors;

a plurality of actuators operatively connected to the controller and selectively displacing the shelf parallel to, transversely to and askew to the travel path in response to at least one output signal to adjust the detected position of the sheet element in such a manner that the shelf is stopped when the front edge of the sheet element reaches the predetermined position thereof;

a gripper bar having a plurality of bar grippers which are aligned with the notches of the leading edge of the shelf in the predetermined position of the front edge of the sheet element, the bar grippers being operative to engage the front edge of the sheet element in the predetermined position.

6. The device defined in claim 5, wherein the shelf gripper includes a comb mounted on the shelf and extending above and parallel to the leading edge of the shelf, the comb being pivotable about a comb axis extending parallel to the leading edge between an engaging position, in which the comb grips the front edge of the sheet element, and a rest position.

7. The device defined in claim 5, wherein the leading edge of the shelf has a plurality of projections alternating with the notches, the comb including a rear bar and a plurality of spaced apart teeth extending from the rear bar and pivotable toward the projections of the leading edge of the shelf in the engaging position of the comb in which the front edge of the sheet element is gripped between the projections and teeth.

8. The device defined in claim 6, wherein the shelf gripper includes at least one spring extending between the rear bar of the shelf gripper and the shelf and biasing the shelf gripper toward the rest position, the shelf gripper further including at least one control element having a telescopic structure which is mounted on the rear bar, the at least one control element being operative to pivot the shelf gripper in the engaging position upon overcoming a spring force of the at least one spring.

9. The device defined in claim 5, further comprises a main motor having a rotatable output shaft and a base cross-member actuated by the main motor to move along the travel path reciprocally between the rear and front positions of the shelf, the base cross-member supporting the plurality of actuators which displace the shelf relative to the base cross-member.

10. The device defined in claim 1, wherein the shelf is displaceable from the rear position of the shelf to the front position of the shelf and back to the rear position during a complete 360° revolution of the output shaft of the main motor.

11. The device defined in claim 9, wherein the plurality of actuators include two side linear electric motors mounted between the base cross-member and the shelf, the side linear electric motors extending along opposite sides of the shelf which flank the leading edge of the shelf, the plurality of actuators further including a central linear electric motor mounted between the shelf and the base cross-member and between the side linear electric motors, each of the side and central linear electric motors having a respective stator, which is mounted on the base cross-member, and a respective rotor, which supports the shelf.

12. The device defined in claim 11, wherein the rotors of the side linear electric actuators each is energized to move parallel to the travel path relative to a respective stator so as to enable displacement of the shelf parallel to the travel path when the rotors of the both side linear electric motors move synchronously over the same distance, the rotor of the central linear electric motor being displaceable transversely to the travel path.

13. The device defined in claim 12, further comprises:

a central elongated guide attached to the shelf and displaceable therewith transversely to the travel path in response to actuation of the central linear electric motor, the central elongated guide extending along a longitudinal axis parallel to the travel path;

a central carriage slidable along the central elongated guide parallel to the travel path in response to actuation of the side line electric motors, and a central pivot extending between the central carriage and the shelf, the shelf being displaceable askew to the travel path when it rotates about the central pivot in response to asynchronous displacement of the rotors of the side linear electric motors.

14. The device defined in claim 13, further comprises:

first and second elongated side guides spaced apart in opposite direction from the central guide and extending transversely to the travel path, each of the side guides being attached to a respective rotor of the side linear electric motor;

first and second side carriages slidable along the first and second elongated side guides, respectively, in response to actuation of the central linear electric motor; and first and second side pivots attached to the first and second side carriages, respectively, and extending toward and attached to the shelf to provide displacement of the shelf askew to the travel path during the asynchronous displacement of the rotors of the side linear motors.

15. The device defined in claim 5, wherein the opto-electronic detectors are selected from the group consisting of photoelectric cells and strips CCD, the opto-electronic detectors being arranged along the path to detect the front edge and the side edges of the sheet element.

16. A device for positioning a sheet element at an introduction station of a processing machine, the sheet element has a front edge, the device comprising:

a shelf movable reciprocally along a path between an upstream and downstream position;

a shelf gripper displaceable with the shelf and releasably engaging the sheet element along the path to advance the sheet element toward a predetermined position of the front edge of the sheet element;

at least one positioning detector located along the path and operative to detect a position of the sheet element on the shelf, the at least one positioning detector being operative to generate at least one signal in response to detection of the position of the sheet element on the shelf while it advances along the path;

a controller operative to receive the at least one signal from the positioning detector and to determine a positioning error of the detected position of the sheet element with respect to a reference position, which is stored in the controller, the controller being operative to generate at least one output signal in response to determining the positioning error; and at least one actuator operatively connected to the controller and selectively displacing the shelf parallel to, transversely to and askew to the travel path in response to the at least one output signal to adjust the detected position of the sheet element in such a manner that the shelf is stopped in the downstream position thereof when the front edge of the sheet element reaches the predetermined position.

* * * * *